United States Patent [19]

Kroebig

[11] 4,079,595

[45] Mar. 21, 1978

[54] FUSIBLE HEAT SINK FOR A CRYOGENIC REFRIGERATOR

[75] Inventor: Helmut L. Kroebig, Rolling Hills Estates, Calif.

[73] Assignee: The United States of America as represented by the Secretary of the Air Force, Washington, D.C.

[21] Appl. No.: 758,879

[22] Filed: Jan. 12, 1977

[51] Int. Cl.[2] ..... F25B 9/00; F25B 19/00; F28D 17/00; F28D 19/00

[52] U.S. Cl. ..... 62/6; 62/467 PR; 62/514 R; 165/10

[58] Field of Search ..... 62/6, 467, 514; 361/381–385; 165/10; 250/352

[56] References Cited

U.S. PATENT DOCUMENTS

| | | | |
|---|---|---|---|
| 3,066,222 | 11/1962 | Poorman et al. | 62/514 |
| 3,253,423 | 5/1966 | Sonnabend | 62/467 |
| 3,422,886 | 1/1969 | Buller | 62/467 |
| 3,423,948 | 1/1969 | Cowan | 62/6 |
| 3,492,830 | 2/1970 | Mulder | 62/467 |
| 3,750,417 | 8/1973 | Johannes et al. | 62/467 |
| 3,899,976 | 8/1975 | Harding et al. | 62/514 |
| 3,908,936 | 9/1975 | Durran | 62/467 |
| 3,933,000 | 1/1976 | Doody | 165/10 |
| 3,970,851 | 7/1976 | Jordan | 62/467 |

*Primary Examiner*—Lloyd L. King
*Attorney, Agent, or Firm*—Joseph E. Rusz; Richard J. Killoren

[57] ABSTRACT

A fusible heat sink for a cryogenic refrigerator used to provide cooling for a detector in the guidance system of a missile. The cryogenic refrigerator has a cold cylinder in contact with the detector and a hot cylinder. The hot cylinder and cold cylinder are connected to a crankcase housing. A heat pipe is connected between the crankcase and the missile skin for providing primary cooling for the crankcase housing. The fusible heat sink is connected to the crankcase with the crankcase forming part of the wall of the heat sink housing. A fusible material is located within the housing. The inside surface of the heat sink housing is coated with nickel and silver to increase the heat transfer between the crankcase and the heat sink.

6 Claims, 4 Drawing Figures

FUSIBLE HEAT SINK FOR A CRYOGENIC REFRIGERATOR

RIGHTS OF THE GOVERNMENT

The invention described herein may be manufactured and used by or for the Government of the United States for all governmental purposes without the payment of any royalty.

BACKGROUND OF THE INVENTION

This invention relates to a system for providing cooling for the detector in the guidance system of a missile.

To cool the detector in the guidance system for some missiles, a cryogenic refrigerator, such as shown in the patent to Doody, U.S. Pat. No. 3,933,000, is built into the nose cone of a missile. A heat pipe is used for transferring heat from the refrigerator crankcase to the skin of the missile.

If the missile skin temperature exceeds the crankcase temperature, the heat pipe is designed to become inoperative. If the heat pipe becomes inoperative due to a rise in skin temperature or due to a malfunction in the heat exchange mechanism, some means is necessary to limit the temperature of the crankcase so as to maintain cooling for the detector. If the crankcase temperature becomes too high, proper cooling of the detector cannot be maintained.

BRIEF SUMMARY OF THE INVENTION

According to this invention, a fusible heat sink is provided in a sealed container adjacent the cryogenic refrigerator crankcase. The crankcase forms a part of the wall for the heat sink. A fusible material is located within the housing. The internal surface of the housing is coated with a layer of nickel and a layer of silver to provide good heat transfer between the heat sink and the crankcase. The heatsink acts as a temporary heat storage mechanism when the heat pipe is inoperative. When the heat pipe again becomes operative, the heat from the crankcase and the fusible heat sink is rejected to the skin of the missile.

IN THE DRAWINGS

DETAILED DESCRIPTION OF THE INVENTION

Figure 1:
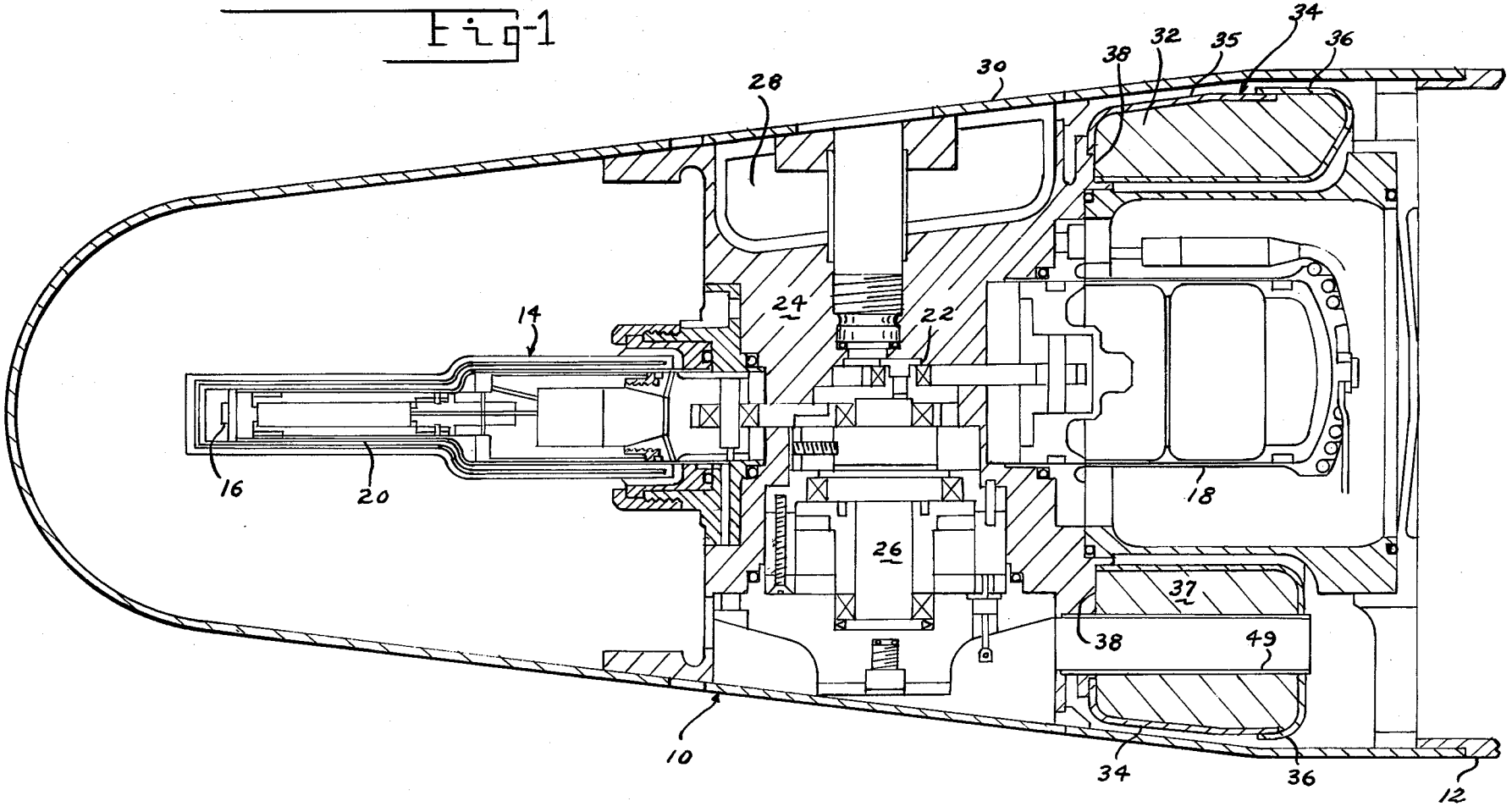
FIG. 1 is a partially schematic sectional view of a missile guidance assembly using the device of the invention.

Reference is now made to FIG. 1 of the drawing which shows a missile guidance assembly 10 which is attached to a missile 12. A cryogenic refrigerator system 14 provides cooling for the detector 16 of the missile guidance system, not shown. The cryogenic refrigerator system is similar to that shown in the patent to Doody except that the hot cylinder 18 is located in alignment with the cold cylinder 20 instead of being located at 90 degrees as shown in the patent. The detector 16 is mounted at the end of cold cylinder 20. A crank system 22 is positioned within a crankcase 24, made of a material such as aluminum. The crank system is driven by a motor 26. The primary heat exchanger for removing heat from the crankcase 24 is a heat pipe 28. The heat pipe 28 rejects heat from the crankcase to the missile skin 30. The heat pipe is designed to become inoperative when the skin exceeds a predetermined value.

Figure 2:
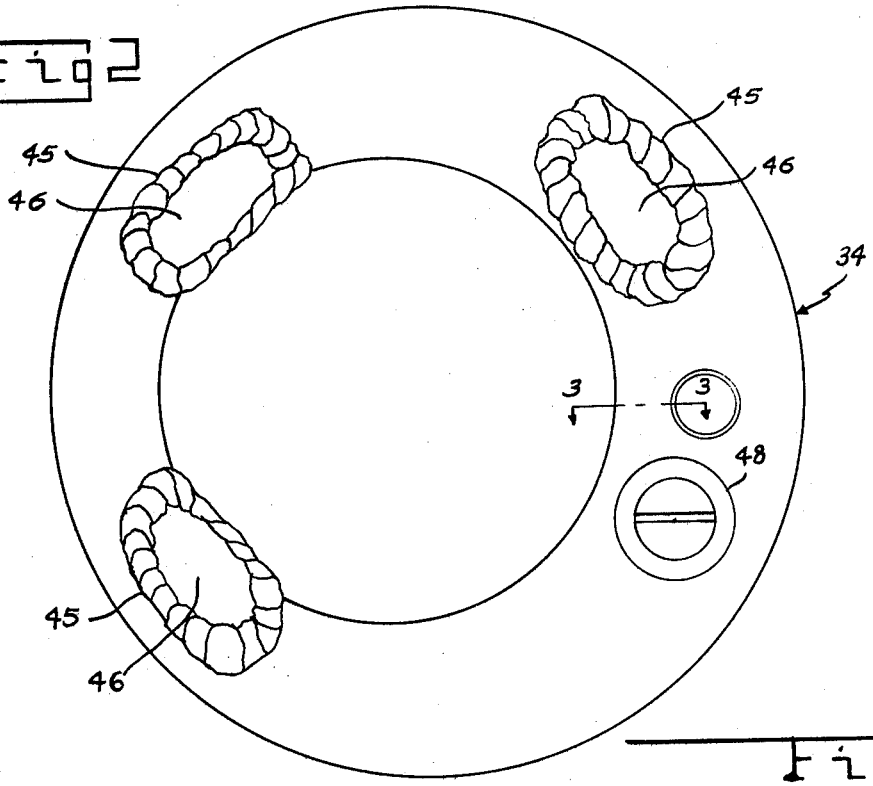
FIG. 2 is a right end view of the heat sink for the device of FIG. 1.

An annular heat sink 32, shown in greater detail in FIG. 2, surrounds the hot cylinder 18. The heat sink 32 acts as a temporary heat storage mechanism when the heat pipe is inoperative.

The heat sink 32 has an aluminum housing 34 made up of parts 35 and 36 and a portion 38 of the crank 24. Parts 35 and 36 are secured to the crankcase 24 and to each other by brazing.

The housing 34 contains a fusible material 37 which melts at a temperature of approximately 260° F. The material used in one device was a metal alloy of 55.5 percent bismuth and 44.5 percent lead with a melting point of 255° F. Other materials could be used which have melting points between 242° and 371° Fahrenheit; for example, Cerro alloy 5500-1 has a melting range of 242°–248° F., Cerro alloy 5684-2 has a melting range of 262°–271° F. These are made by Cerro Sales Corporation. Other materials which can be used are 2-napthol which melts at approximately 251° F.; 2, 4 and 6 tribromoaniline which melts at approximately 251° F.; sulfer which melts at 246° F. and trans-stilbene which melts at approximately 255° F. If a different melting temperature range is desired, other materials could be used.

To assure minimum thermal resistance and good melting characteristics between the heat sink material and the crankcase, the inner surface of housing 34, including surface 38, is plated. In tests, it was found that silver plating on top of a deposited layer of nickel provided maximum thermal conductivity.

Figure 3:
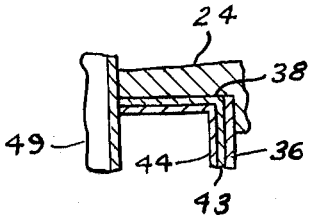
FIG. 3 is an enlarged partially schematic, partially cut away sectional view of the device of FIG. 2 along the line 3—3.

To coat the inner surface of housing 34 with a layer of nickel 43 and a layer of silver 44, as shown in FIG. 3, it was necessary to cut openings at 45 in the housing 34. Covers 46 were welded over the openings to make the housing leak tight.

A fill opening 48 is provided in the housing 34. A tubular member 49 was brazed into the housing 34 to provide a passage for the detector and temperature sensing thermocouple leads.

Figure 4:
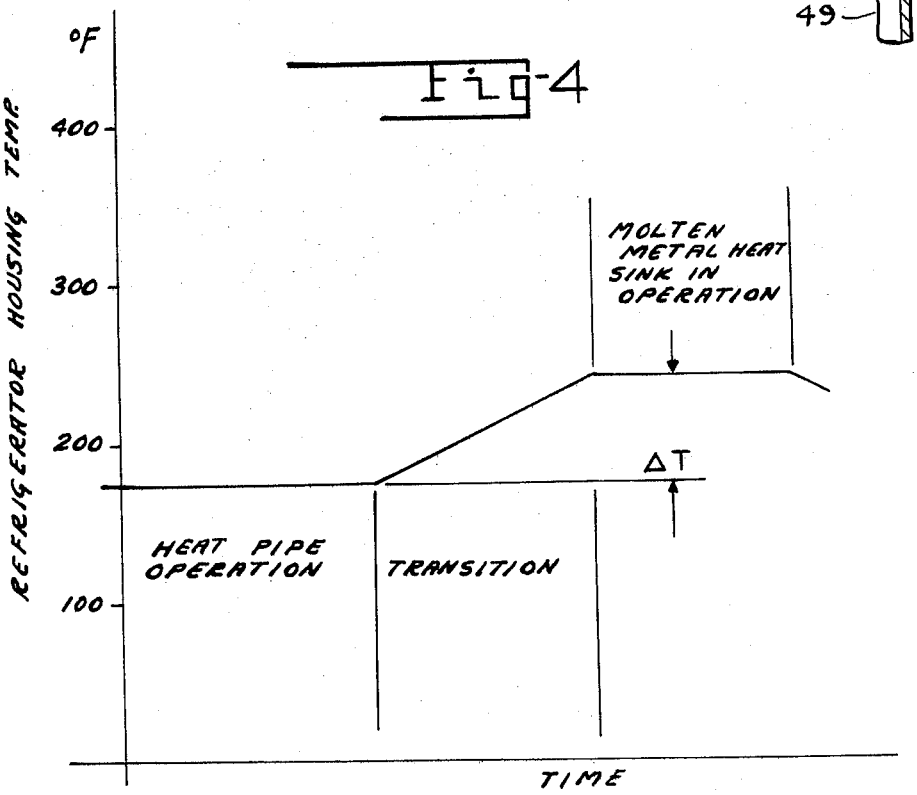
FIG. 4 shows a representative temperature-time plot for the crankcase of the device of FIG. 1.

In the operation of the device, with the heat pipe in operation the crankcase is held at some value as indicated in the first portion of the illustration in FIG. 4. If the heat pipe becomes inoperative, such as when the skin temperature exceeds a predetermined level, or if the heat pipe becomes inoperative, such as under temporary high heat rejection loads, the crankcase temperature will rise as indicated in the transition portion of the illustration in FIG. 4. When the crankcase temperature rises to a level where the fusible material in the heat sink starts to melt, the crankcase temperature will again stabilize at a higher temperature as shown in the third portion of the illustration in FIG. 4. When the heat pipe again becomes operative, it will reject heat from both the crankcase and heat sink and the heat sink will return to its solid state.

The third portion of the illustration in FIG. 4 could represent the free flight of a missile, in which case the end of the third portion of the illustration in FIG. 4 could indicate the time that the missile reaches the target.

There is thus provided a fusible heat sink for use in combination with a cryogenic refrigeration system and heat pipe primary cooling system to limit the temperature of crankcase of the refrigeration system when the heat pipe is inoperative.

I claim:

1. In combination with a missile guidance assembly having an outer skin forming the outer surface of the missile guidance system; said outer skin being adapted for securing to a missile; a detector, for the guidance system of the missile, within the outer skin; a cooling system, for said detector, including a cryogenic refrigerator having a hot cylinder, a cold cylinder, a crank system interconnecting the hot cylinder and the cold cylinder and a crankcase surrounding the crank system and a heat pipe system for transferring heat from the crankcase to the missile skin; apparatus for removing heat from the crankcase when the heat pipe system is inoperative, comprising: a heat sink, within the missile guidance skin; said heat sink including an annular housing member; said housing member being secured to the crankcase with a portion of the crankcase forming a wall of a heat sink housing; a fusible material, having a melting point within the range between 242° F. and 271° F., within said housing; means within said housing for providing a good heat transfer between the fusible material and the crankcase.

2. The device as recited in claim 1 wherein said means for providing a good heat transfer between the fusible material and the crankcase comprises a layer of nickel covering the inner surface of the heat sink housing including the portion of the crankcase and a second layer of silver covering the first layer of nickel.

3. The device as recited in claim 2 wherein said fusible material is an alloy of bismuth and lead.

4. The device as recited in claim 3 wherein said fusible material includes 55.5% bismuth and 44.5 percent lead.

5. The device as recited in claim 2 wherein said fusible material in 2-napthol.

6. The device as recited in claim 2 wherein said fusible material is Trans-stilbene.

* * * * *